US009984641B2

(12) United States Patent
Kang et al.

(10) Patent No.: US 9,984,641 B2
(45) Date of Patent: May 29, 2018

(54) GATE PROTECTION CIRCUIT AND DISPLAY DEVICE INCLUDING THE SAME

(71) Applicant: Samsung Display Co., Ltd., Yongin-si, Gyeonggi-do (KR)

(72) Inventors: Sung In Kang, Yongin-si (KR); Kyun Ho Kim, Yongin-si (KR); Min Ho Park, Yongin-si (KR); Ji Eun Jang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 22 days.

(21) Appl. No.: 15/158,471

(22) Filed: May 18, 2016

(65) Prior Publication Data

US 2017/0039974 A1 Feb. 9, 2017

(30) Foreign Application Priority Data

Aug. 4, 2015 (KR) ..... 10-2015-0110223

(51) Int. Cl.

*G09G 3/20* (2006.01)
*G09G 3/36* (2006.01)
*G09G 3/3266* (2016.01)

(52) U.S. Cl.

CPC ..... *G09G 3/3677* (2013.01); *G09G 3/20* (2013.01); *G09G 3/3266* (2013.01); *G09G 3/3674* (2013.01); *G09G 3/3688* (2013.01); *G09G 3/3696* (2013.01); *G09G 2310/0267* (2013.01); *G09G 2320/0219* (2013.01); *G09G 2330/04* (2013.01); *G09G 2330/06* (2013.01); *G09G 2330/08* (2013.01); *G09G 2330/12* (2013.01)

(58) Field of Classification Search

CPC ..... G09G 3/3677; G09G 3/20; G09G 3/3266; G09G 3/3674; G09G 3/3688; G09G 3/3696; G09G 2310/0264; G09G 2310/0278; G09G 2310/0281; G09G 2310/0286; G06F 11/1604

See application file for complete search history.

(56) References Cited

U.S. PATENT DOCUMENTS 8,659,583 B2 2/2014 Cho
9,595,214 B2 * 3/2017 Seo ..... G09G 3/006
2008/0043011 A1 * 2/2008 Lee ..... G09G 3/3611 345/212

(Continued)

OTHER PUBLICATIONS

EPO Extended Search Report dated Nov. 16, 2016, for corresponding European Patent Application No. 16179193.4 (9 pages).

*Primary Examiner* — Jennifer Mehmood
*Assistant Examiner* — Sardis F Azongha
(74) *Attorney, Agent, or Firm* — Lewis Roca Rothgerber Christie LLP

(57) ABSTRACT

A gate protection circuit includes: a clock signal generator to generate a plurality of gate clock signals; a gate driver to output gate signals based on the plurality of gate clock signals, the gate driver including a plurality of gate driving circuits cascaded to each other; and a monitoring line configured to transmit a feedback signal based on the plurality of gate clock signals via the plurality of gate driving circuits to the clock signal generator. The clock signal generator is to block generation of the plurality of gate clock signals in response to the feedback signal.

18 Claims, 5 Drawing Sheets

(56) References Cited

U.S. PATENT DOCUMENTS

| | | | | |
|---|---|---|---|---|
| 2011/0148825 | A1* | 6/2011 | Ueno | G09G 3/006 345/204 |
| 2011/0199344 | A1* | 8/2011 | Kimura | G09G 3/20 345/204 |
| 2012/0056857 | A1 | 3/2012 | Li et al. | |
| 2013/0201171 | A1 | 8/2013 | Song | |
| 2015/0026506 | A1 | 1/2015 | Lee et al. | |

* cited by examiner

GATE PROTECTION CIRCUIT AND DISPLAY DEVICE INCLUDING THE SAME

CROSS-REFERENCE TO RELATED APPLICATION

This application claims priority to, and the benefit of, Korean Patent Application No. 10-2015-0110223, filed on Aug. 4, 2015, in the Korean Intellectual Property Office, the contents of which are incorporated herein by reference in their entirety.

BACKGROUND

1. Field

One or more aspects of example embodiments of the present invention relate to a gate protection circuit, and a display device including the same.

2. Description of the Related Art

A display device, such as a liquid crystal display device, includes a display unit to display images, and a data driving unit and a gate driving unit to drive the display unit. The display unit includes a plurality of pixels connected to gate lines and data lines.

Each of the pixels includes a switching element, a liquid crystal capacitor, and a storage capacitor.

The gate driving unit includes a plurality of gate driving circuits that are cascaded to one another, and each gate driving circuit supplies gate signals to a display panel based on gate clock signals. However, when an error occurs in the gate driving unit that may be caused by static electricity and/or noise, and/or that may be caused when the gate clock signal is short-circuited, a normal driving of the gate driving circuit may not be possible, and there may be a possibility of a fire outbreak, because high voltage and high current may flow in the gate signal line.

For example, when the gate driving unit is directly mounted on the display panel, the gate driving unit may be exposed to a high danger caused by diverse noises. Further, in the case of a multi-channel structure that uses a plurality of gate clock signals, there may be difficulties in detecting errors for each of the multi-channels.

The above information disclosed in this Background section is for enhancement of understanding of the background of the invention, and therefore, it may contain information that does not constitute prior art.

SUMMARY

One or more aspects of example embodiments of the present invention provide a gate protection circuit capable of protecting a gate driving unit when operating abnormally, and a display device including the same.

One or more aspects of example embodiments of the present invention provide a gate protection circuit that raises an error detection rate of a gate driving unit (e.g., a gate driver) with improved reliability and stability, and a display device including the same.

According to an embodiment of the present invention, a gate protection circuit includes: a clock signal generator configured to generate a plurality of gate clock signals; a gate driver configured to output gate signals based on the plurality of gate clock signals, the gate driver including a plurality of cascading gate driving circuits; and a monitoring line configured to transmit a feedback signal based on the plurality of gate clock signals via the plurality of gate driving circuits to the clock signal generator, the clock signal generator being configured to block generation of the plurality of gate clock signals in response to the feedback signal.

A plurality of gate clock lines corresponding to the plurality of gate clock signals may be connected in parallel and may be connected to the monitoring line.

Each of the plurality of gate clock lines may be connected to a diode configured to prevent reverse current.

The feedback signal may include a voltage in which the plurality of gate clock signals overlap each other.

The gate clock signals may have a same cycle and different phases.

The plurality of gate clock signals may include n gate clock signals each configured to be phase-shifted by 1/nth of one cycle and to be output sequentially.

The clock signal generator may be configured to block the generation of the plurality of gate clock signals when the feedback signal includes a blank section or a low level.

The gate protection circuit may further include a timing controller configured to generate a plurality of gate generation signals to control the gate driver, and the clock signal generator may be configured to generate the plurality of gate clock signals in response to the plurality of gate generation signals.

The clock signal generator may include: a booster configured to boost the plurality of gate generation signals, and to output the plurality of gate clock signals; an error detection circuit configured to detect whether the feedback signal is lower than a reference voltage; a switching control circuit configured to output a switching-off control signal to block the generation of the plurality of gate clock signals when the feedback signal is lower than the reference voltage; and a switcher configured to turn off transmission channels of the plurality of gate generation signals in response to the switching-off control signal.

According to an embodiment of the present invention, a display device, includes: a display panel including a plurality of pixels configured to emit light in response to gate signals and data signals; a data driver configured to output the data signals to the display panel; a clock signal generator configured to generate a plurality of gate clock signals; a gate driver including a plurality of gate driving circuits cascaded to each other, and configured to output the gate signals based on the plurality of gate clock signals; and a monitoring line configured to transmit a feedback signal based on the plurality of gate clock signals via the plurality of gate driving circuits to the clock signal generator, the clock signal generator being configured to block generation of the plurality of gate clock signals in response to the feedback signal.

The gate driver may include a first gate driver at a side region of the display panel, and a second gate driver at another side region of the display panel.

The monitoring line may include a first monitoring line configured to transmit a first feedback signal from the first gate driver to the clock signal generator, and a second monitoring line configured to transmit a second feedback signal from the second gate driver to the clock signal generator.

The first monitoring line may be at the side region of the display panel, and the second monitoring line may be at the other side region of the display panel.

The clock signal generator may be configured to block the generation of the plurality of gate clock signals when at least one of the first and second feedback signals comprises a blank section or a low level.

The display panel may further include a timing controller configured to generate a plurality of gate generation signals to control the gate driver, and the clock signal generator may be configured to generate the plurality of gate clock signals in response to the plurality of gate generation signals.

The clock signal generator may include: a booster configured to boost the plurality of gate generation signals, and to output the plurality of gate clock signals; an error detection circuit configured to detect whether at least one of the first and second feedback signals is lower than a reference voltage; a switching control circuit configured to output a switching-off control signal to block the generation of the plurality of gate clock signals when at least one of the first and second feedback signals is lower than the reference voltage; and a switcher configured to turn off transmission channels of the plurality of gate generation signals in response to the switching-off control signal.

The error detection circuit may include: an AND gate configured to receive the first and second feedback signals and to perform an AND operation; and a comparator configured to compare an output voltage of the AND gate with the reference voltage.

The switching control circuit may be configured to output the switching-off control signal when the output voltage of the error detection circuit is at a low level.

The display panel may be an amorphous silicon gate (ASG) display panel.

BRIEF DESCRIPTION OF THE DRAWINGS

The above and other aspects and features of embodiments of the present invention will become apparent to those skilled in the art from the following detailed description of the example embodiments with reference to the accompanying drawings, in which like reference numerals refer to like elements throughout.

DETAILED DESCRIPTION

Figure 1A:
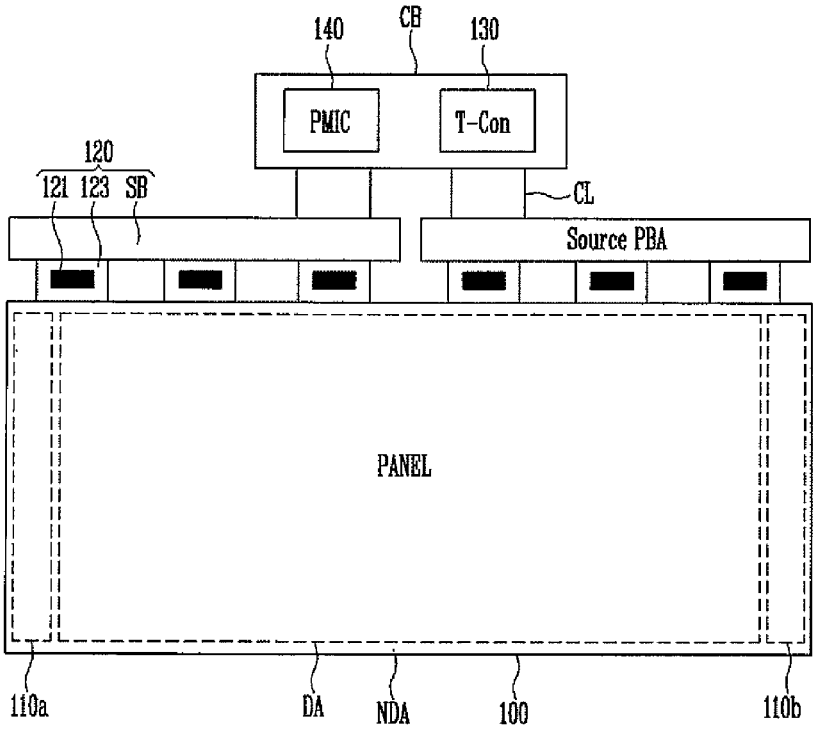
FIG. 1A illustrates a schematic block diagram of a display device.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the ad. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated.

In the drawings, the relative sizes of elements, layers, and regions may be exaggerated for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 1B:
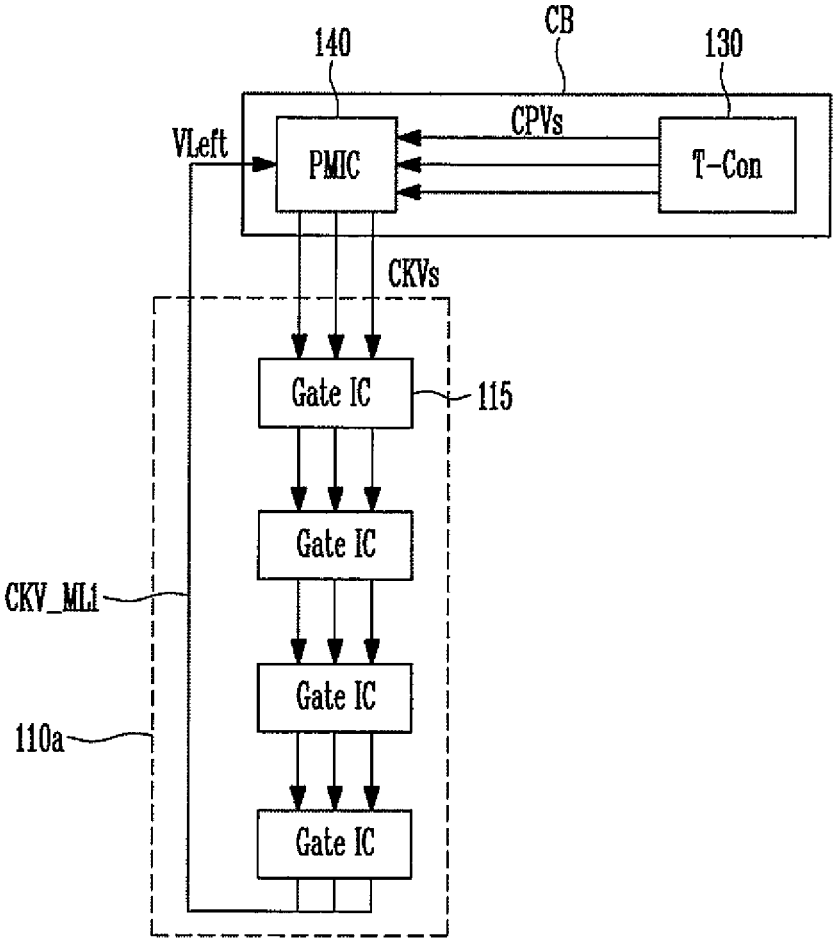
FIG. 1B is a partial enlarged view of the display device shown in FIG. 1A, according to an embodiment of the present invention.

FIG. 1A illustrates a schematic block diagram of a display device, and FIG. 1B is a partial enlarged view of the display device shown in FIG. 1A, according to an embodiment of the present invention.

Referring to FIGS. 1A and 1B, a display device according to an embodiment of the present invention may include a display panel 100, a gate driving unit (e.g., a gate driver) 110*a* and 110*b*, a data driving unit (e.g., a data driver) 120, a timing control unit (e.g., a timing controller) 130, and a clock signal generating unit (e.g., a clock signal generator) 140.

The display panel 100 may include a plurality of pixels for emitting light in response to gate signals and data signals. The display panel 100 may include a display region DA including the plurality of pixels, and a non-display region NDA adjacent the display region DA. The images may be displayed at the display region DA, but not at the non-display region NDA. The display panel 100 may include a glass substrate, a silicon substrate, or a film substrate.

The display panel 100 according to an embodiment of the present invention may be a liquid crystal display panel of amorphous silicon gate (ASG), and the gate driving unit 110*a* and 110*b* may be mounted on the display panel 100. However, the present invention is not limited thereto, and in other embodiments, the display panel 100 may be an organic light emitting display panel, an electrophoretic display panel, a plasma display panel, etc.

The gate driving unit 110*a* and 110*b* may output the gate signals to the display panel 100 based a plurality of gate clock signals CKVs supplied from a control board CB. The gate driving unit 110*a* and 110*b* according to an embodiment may include a first gate driving unit (e.g., a first gate driver) 110*a* mounted at one side region of the display panel 100, and a second gate driving unit (e.g., a second gate driver) 110*b* mounted at the other side region (e.g., opposite side region) of the display panel 100. For example, the first and second gate driving units 110*a* and 110*b* may be positioned at a left side region and a right side region, respectively, of the non-display region NDA with the display region DA of the display panel 100 therebetween. Because a composition and a driving principle of the first and second gate driving units 110*a* and 110*b* are the same or substantially the same as each other, hereinafter, only the first gate driving unit 110*a* will be described in more detail.

The first gate driving unit 110*a* may include a plurality of cascading gate driving circuits 115 (e.g., gate driving circuits 115 that are cascaded to one another) (see FIG. 1B). The plurality of gate driving circuits 115 may have a cascade structure, and may be configured to operate after receiving a plurality of gate clock signals CKVs from the control board CB or from a previous gate driving circuit 115 that forwards the gate clock signals CKVs to a next gate driving circuit 115.

The last gate driving circuit 115, from among the plurality of gate driving circuits 115, may be connected to a monitoring line CKV_ML1. The monitoring line CKV_ML1 may transmit a feedback signal VLeft, which is based on the plurality of gate clock signals CKVs via the plurality of gate driving circuits 115, to the clock signal generating unit 140. In other words, the monitoring line CKV_ML1 may electrically connect the gate driving unit 110*a* that is mounted on the display panel 100 to the clock signal generating unit 140 that is mounted on the control board CB, and may supply a conductive path of a feedback voltage.

A part of the monitoring line CKV_ML1 may be included on the gate driving unit 110*a*, or may be formed on the display panel 100.

In more detail, a plurality of gate clock lines corresponding to a plurality of gate clock signals CKVs may be connected in parallel to the monitoring line CKV_ML1. In other words, the plurality of gate clock signals CKVs output from the last gate driving circuit 115, from among the plurality of gate driving circuits 115, may overlap with each other to form the feedback voltage, and the feedback voltage may be transmitted through the monitoring line CKV_ML1.

The data driving unit 120 may output the data signals to the display panel 100. The data driving unit 120 may include a data driving circuit 121, a data flexible circuit board 123, and a source board SB (see FIG. 1A). The data driving circuit 121 may generate the data signals applied to the display panel 100. The data driving circuit 121 may be mounted on the data flexible circuit board 123, and may electrically connect the display panel 100 to the source board SB. The source board SB may be connected to the data flexible circuit board 123, and may forward data driving signals provided from the control board CB to the data flexible circuit board 123. The source board SB may be a source printed board assembly (PBA).

The control board CB may be electrically connected to the source board SB through a control cable CL, and may output various control signals to control the gate driving unit 110*a* and 110*b* and the data driving unit 120. The timing control unit 130 and the clock signal generating unit 140 may be mounted on the control board CB.

The timing control unit 130 may generate the control signals to drive the gate driving unit 110*a* and 110*b*, and may generate the control signals to drive the data driving unit 120. For example, the timing control unit 130 may generate a plurality of gate generation signals CPVs to control the gate driving unit 110*a* and 110*b*. The gate generation signals CPVs may be used to control an output timing of a gate-on pulse of the gate signal.

The clock signal generating unit 140 may generate the plurality of gate clock signals CKVs in response to the plurality of gate generation signals CPVs.

However, the clock signal generating unit 140 may block the generation of the plurality of gate clock signals CKVs in response to the feedback signal VLeft. In more detail, the clock signal generating unit 140 may block the generation of the plurality of gate clock signals CKVs when a blank section and/or a low level occurs in the feedback signal VLeft. Because the feedback signal VLeft is based on the plurality of gate clock signals CKVs via the plurality of gate driving circuits 115, when the gate clock lines are disconnected or short-circuited, the clock signal generating unit 140 may analyze the feedback signal VLeft to determine whether the driving is normal. According to an embodiment of the present invention, the clock signal generating unit 140 may be or may include a power management IC (PMIC).

Figure 2:
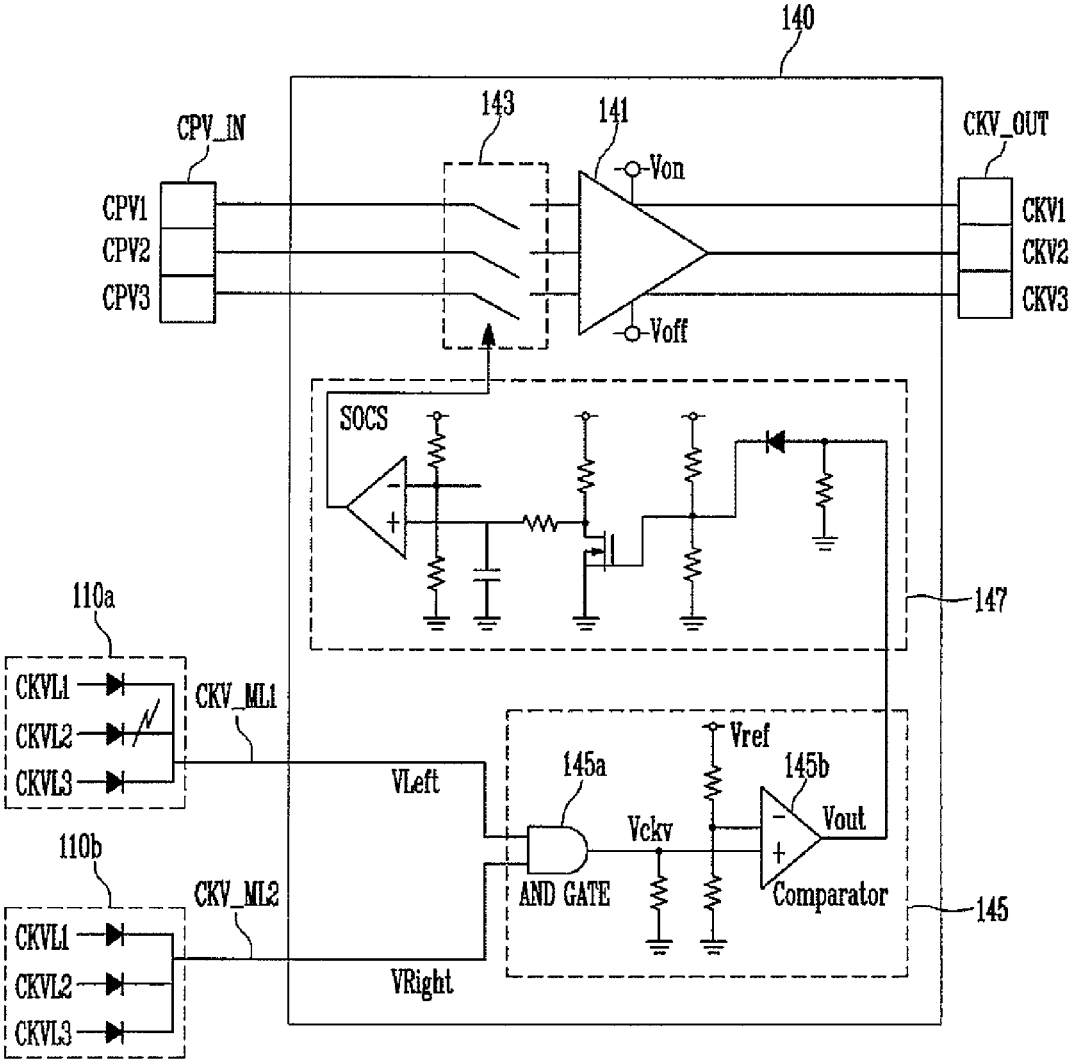
FIG. 2 illustrates a detailed block diagram of a clock signal generating unit according to an embodiment of the present invention.

FIG. 2 illustrates a detailed block diagram of a clock signal generating unit (e.g., a clock signal generator) according to an embodiment of the present invention.

Referring to FIG. 2, the clock signal generating unit 140 according to an embodiment of the present invention may receive the first feedback signal VLeft from the first gate driving unit 110*a* through the first monitoring line CKV_ML1, and may receive a second feedback signal VRight from the second gate driving unit 110*b* through a second monitoring line CKV_ML2. Each of the first and second monitoring lines CKV_ML1 and CKV_ML2 may be connected to a plurality of gate clock lines CKVL1, CKVL2, and CKVL3, which are connected in parallel, and which respectively correspond to the plurality of gate clock signals CKV1, CKV2, and CKV3.

According to an embodiment of the present invention, the first gate clock signal CKV1 may be transferred through the first gate clock line CKVL1, the second gate clock signal CKV2 may be transferred through the second gate clock line CKVL2, and the third gate clock signal CKV3 may be transferred to the third gate clock line CKVL3. A diode may be coupled to each of the plurality of gate clock lines CKVL1, CKVL2, and CKVL3, to prevent or substantially prevent reverse current. Because the plurality of gate clock lines CKVL1, CKVL2, and CKVL3 are connected in parallel and connected to the first monitoring line CKV_ML1, the feedback signal VLeft may have a voltage value in which the plurality of gate clock signals CKV1, CKV2, and CKV3 overlap with each other. The plurality of gate clock signals CKV1, CKV2, and CKV3 may have the same or substantially the same cycle but may have difference phases. According to an embodiment of the present invention, each of the three gate clock signals CKV1, CKV2, and CKV3 may be phase-shifted by one third of one cycle, and may be output sequentially.

The clock signal generating unit 140 may include a boosting unit (e.g., a booster) 141 and a switching unit (e.g., a switcher) 143. The boosting unit 141 is configured to boost the plurality of gate generation signals CPV1, CPV2, and CPV3 and to output the plurality of gate clock signals CKV1, CKV2, and CKV3. The switching unit 143 is configured to turn on or off the transmission channels of the plurality of gate generation signals CPV1, CPV2, and CPV3 applied to the boosting unit 141.

The clock signal generating unit 140 may include an error detection circuit 145 and a switching control circuit 147. The error detection circuit 145 is configured to detect whether or not a voltage level of at least one of the first and second feedback signals VLeft and VRight is lower than that of the reference voltage Vref. The switching control circuit 147 is configured to output a switching-off control signal SOCS to block the generation of the plurality of gate clock signals CKV1, CKV2, and CKV3 when the voltage level of at least one of the first and second feedback signals VLeft and VRight is lower than that of the reference voltage Vref. The switching unit 143 may turn off the transmission channels of the plurality of gate clock signals CKV1, CKV2, and CKV3 in response to the switching-off control signal SOCS.

According to an embodiment of the present invention, the error detection circuit 145 may include an AND gate 145*a* and a comparator 145*b*. The AND gate 145*a* is configured to receive the first and second feedback signals VLeft and VRight, and to perform an AND operation. The comparator 145*b* is configured to compare an output voltage Vckv of the AND gate 145*a* with the reference voltage Vref. For example, when the second gate clock line CKVL2 of the gate driving unit 110*a* is short-circuited, the first feedback signal VLeft may include a waveform having the first and third gate clock signals CKV1 and CKV3 overlapping each other without the second gate clock signal CKV2, and the first feedback signal VLeft may have the blank section, which is not a suitable level (e.g., a predetermined level), or the first feedback signal VLeft may have the low level.

The AND gate 145*a* may output the output voltage Vckv at the low level when the low level occurs in one of the first feedback signal VLeft and the second feedback signal VRight. The comparator 145*b* may receive the output voltage Vckv through one terminal (e.g., a non-inverting input terminal +) and the reference voltage Vref through another terminal (e.g., an inverting input terminal −), and may output an output voltage Vout at the low level when the output voltage Vckv is lower than the reference voltage Vref. Further, when the output voltage Vout of the error detection circuit 145 is at the low level, the switching control circuit 147 may output the switching-off control signal SOCS. Accordingly, the transmission channels of the plurality of gate generation signals CPV1, CPV2, and CPV3 may be turned off, and the supply thereof to the boosting unit 141 may be blocked.

However, the clock signal generating unit 140 is not limited to the above circuit structure. For example, the clock signal generating unit 140 may be embodied in various circuit structures configured to block the output of the plurality of gate clock signals CKV1, CKV2, and CKV3, when the feedback signal is abnormal.

Figure 3A:
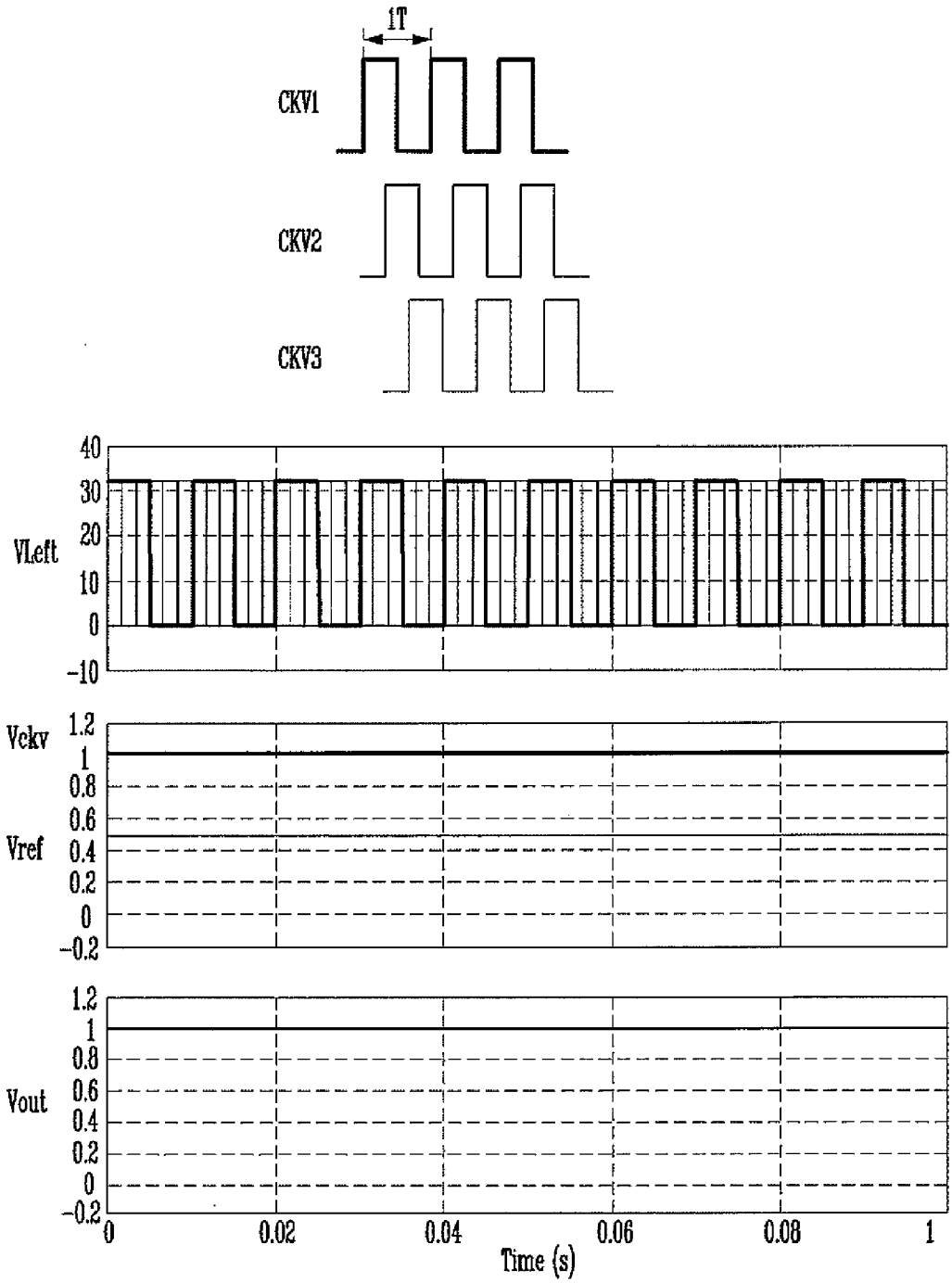
FIG. 3A illustrates waveform diagrams of a gate protection circuit during normal driving.
Figure 3B:
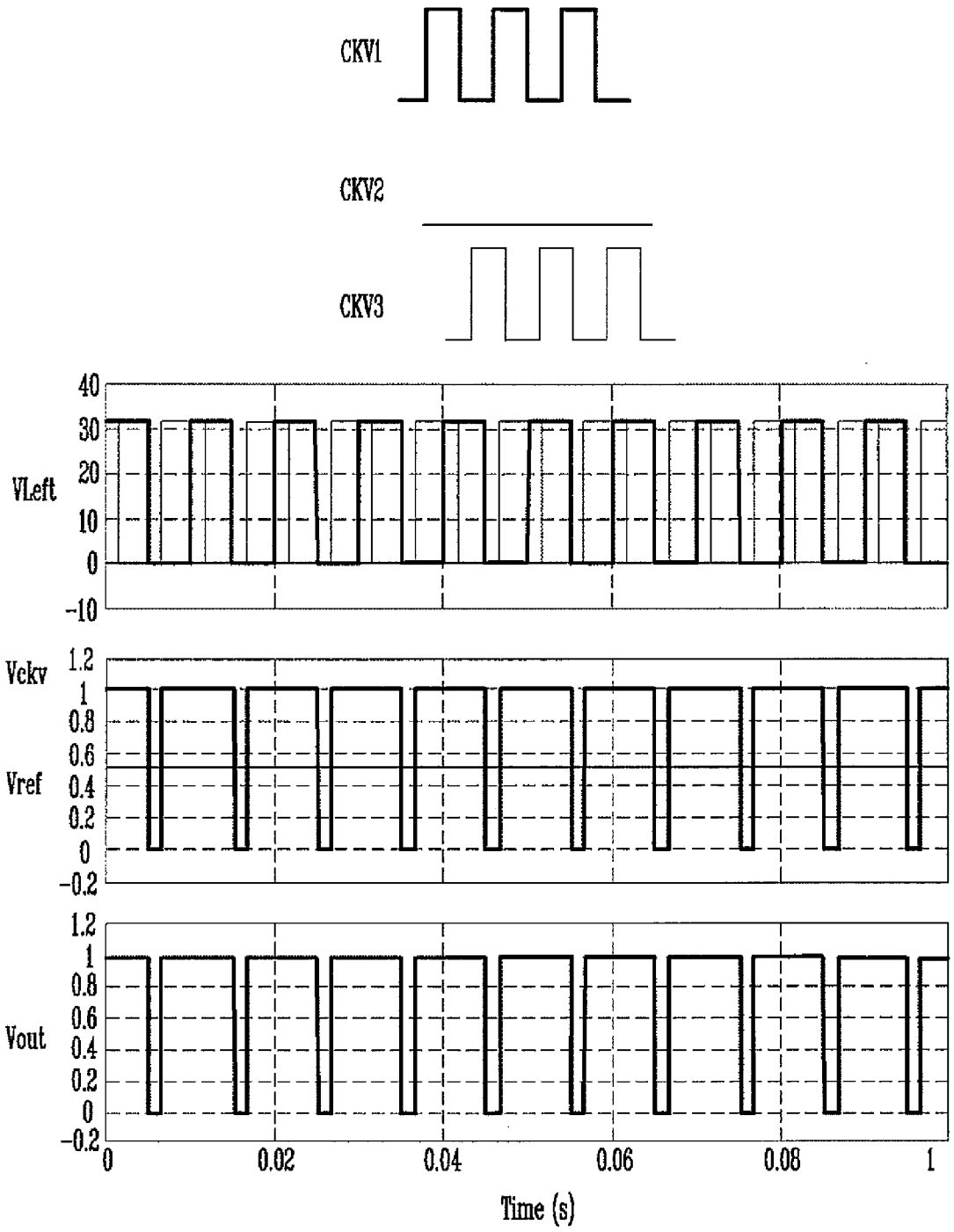
FIG. 3B illustrates waveform diagrams of a gate protection circuit when an error occurs, according to an embodiment of the present invention.

FIG. 3A illustrates waveform diagrams of a gate protection circuit during normal driving, and FIG. 3B illustrates waveform diagrams of a gate protection circuit when an error occurs, according to an embodiment of the present invention.

Referring to FIGS. 3A and 3B, the plurality of gate clock signals CKV1, CKV2, and CKV3 may include pulse waveforms that swings between the low level and the high level.

The plurality of gate clock signals CKV1, CKV2, and CKV3 may have the same or substantially the same cycle, and may have different phases.

When the first gate signal CKV1 is a reference signal, the second gate clock signal CKV2 may be delayed by one third of a cycle later than that of the first gate clock signal CKV1. The third gate clock signal CKV3 may be delayed by one third of a cycle later than the second gate clock signal CKV2.

When the plurality of gate clock signals CKV1, CKV2, and CKV3 are normally applied to the gate driving circuits 115, the first feedback signal VLeft may have a high level (e.g., a continuous high level) according to the plurality of gate clock signals CKV1, CKV2, and CKV3 overlapping each other.

For example, the high level of the plurality of gate clock signals CKV1, CKV2, and CKV3 may be about 32V, and the low level thereof may be about 0V. Accordingly, the first feedback signal VLeft may be a DC voltage of about 32V. Further, the second feedback signal VRight may be a DC voltage, which may be the same or substantially the same as that of the first feedback signal VLeft.

The AND gate 145*a* of the error detection circuit 145 may output the output voltage Vckv at the high level because the first and second feedback signals VLeft and VRight at the high level are input thereto, and the comparator 145*b* may compare the output voltage Vckv of the AND gate 145*a* with the reference voltage Vref. The reference voltage Vref may be set to, for example, about 0.5V higher than the low level of 0V. For example, when the high level of the output voltage Vckv of the AND gate 145*a* is about 1V, the high level of the output voltage Vckv may be higher than the reference voltage Vref of about 0.5V. Therefore, the output voltage Vout of the comparator 145*b* may maintain the high level of about 1V.

When the second gate clock line CKVL2 of the first gate driving unit 110*a* is short-circuited and in an abnormal state, the second gate clock line CKVL2 may have a low level. The first feedback signal VLeft may have the blank section or the low level. In other words, the first feedback signal VLeft may have a pulse waveform in which the first feedback signal VLeft maintains a high level but drops into the low level during a section (e.g., a predetermined section) thereof. When the first feedback signal VLeft at the low level is input to the AND gate 145*a* of the error detection circuit 145, the output voltage Vckv at the low level may be output, and when the output voltage Vckv of the AND gate 145*a* has the low level, because the output voltage Vckv is lower than the reference voltage Vref of about 0.5V, the low level may occur in the output voltage Vout of the comparator 145*b*. Further, because the output voltage Vout of the error detection circuit 145 is at the low level, the switching control circuit 147 may output the switching-off control signal SOCS. Accordingly, the transmission channels of the plurality of gate generation signals CPV1, CPV2, and CPV3 may be turned off, and the supply thereof to the boosting unit 141 may be blocked.

According to one or more aspects of example embodiments of the present invention, by constructing a gate protection circuit configured to transmit a feedback signal based on a plurality of gate clock signals to a monitoring line (e.g., a single monitoring line), and to block the generation of the plurality of gate clock signals in response to the feedback signal, an error detection rate of the gate driving unit may be increased, and the reliability and stability may be improved.

Further, because the errors are detected through the monitoring line (e.g., the single monitoring line), regardless of a number of the gate clock signals, the efficiency of the space may be improved.

Example embodiments have been described herein, and although specific terms are employed, they are used and are to be interpreted in a generic and descriptive sense only, and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments, unless otherwise specifically indicated. Accordingly, it will be understood by those of skill in the art that various changes in form and details may be made without departing from the spirit and scope of the present invention as set forth in the following claims, and their equivalents.

What is claimed is:

1. A gate protection circuit comprising:

a clock signal generator configured to generate a plurality of gate clock signals;

a gate driver configured to output gate signals based on the plurality of gate clock signals, the gate driver comprising a plurality of cascading gate driving circuits; and a monitoring line configured to transmit a feedback signal based on the plurality of gate clock signals via the plurality of gate driving circuits to the clock signal generator, wherein the clock signal generator is configured to block generation of the plurality of gate clock signals in response to the feedback signal, wherein a plurality of gate clock lines corresponding to the plurality of gate clock signals are connected to the monitoring line.

2. The gate protection circuit of claim 1, wherein each of the plurality of gate clock lines is connected to a diode configured to prevent reverse current.

3. The gate protection circuit of claim 2, wherein the feedback signal comprises a voltage in which the plurality of gate clock signals overlap each other.

4. The gate protection circuit of claim 3, wherein the gate clock signals have a same cycle and different phases.

5. The gate protection circuit of claim 4, wherein the plurality of gate clock signals comprises n gate clock signals each configured to be phase-shifted by 1/nth of one cycle and to be output sequentially.

6. The gate protection circuit of claim 1, wherein the clock signal generator is configured to block the generation of the plurality of gate clock signals when the feedback signal comprises a blank section or a low level.

7. The gate protection circuit of claim 6, further comprising a timing controller configured to generate a plurality of gate generation signals to control the gate driver, wherein the clock signal generator is configured to generate the plurality of gate clock signals in response to the plurality of gate generation signals.

8. The gate protection circuit of claim 7, wherein the clock signal generator comprises:

a booster configured to boost the plurality of gate generation signals, and to output the plurality of gate clock signals;

an error detection circuit configured to detect whether the feedback signal is lower than a reference voltage;

a switching control circuit configured to output a switching-off control signal to block the generation of the plurality of gate clock signals when the feedback signal is lower than the reference voltage; and a switcher configured to turn off transmission channels of the plurality of gate generation signals in response to the switching-off control signal.

9. A display device, comprising:

a display panel comprising a plurality of pixels configured to emit light in response to gate signals and data signals;

a data driver configured to output the data signals to the display panel;

a clock signal generator configured to generate a plurality of gate clock signals;

a gate driver comprising a plurality of gate driving circuits cascaded to each other, and configured to output the gate signals based on the plurality of gate clock signals; and a monitoring line configured to transmit a feedback signal based on the plurality of gate clock signals via the plurality of gate driving circuits to the clock signal generator, wherein the clock signal generator is configured to block generation of the plurality of gate clock signals in response to the feedback signal, wherein a plurality of gate clock lines corresponding to the plurality of gate clock signals are connected to the monitoring line.

10. The display device of claim 9, wherein the gate driver comprises a first gate driver at a side region of the display panel, and a second gate driver at another side region of the display panel.

11. The display device of claim 10, wherein the monitoring line comprises a first monitoring line configured to transmit a first feedback signal from the first gate driver to the clock signal generator, and a second monitoring line configured to transmit a second feedback signal from the second gate driver to the clock signal generator.

12. The display device of claim 11, wherein the first monitoring line is at the side region of the display panel, and wherein the second monitoring line is at the other side region of the display panel.

13. The display device of claim 12, wherein the clock signal generator is configured to block the generation of the plurality of gate clock signals when at least one of the first and second feedback signals comprises a blank section or a low level.

14. The display device of claim 13, further comprising a timing controller configured to generate a plurality of gate generation signals to control the gate driver, wherein the clock signal generator is configured to generate the plurality of gate clock signals in response to the plurality of gate generation signals.

15. The display device of claim 14, wherein the clock signal generator comprises:

a booster configured to boost the plurality of gate generation signals, and to output the plurality of gate clock signals;

an error detection circuit configured to detect whether at least one of the first and second feedback signals is lower than a reference voltage;

a switching control circuit configured to output a switching-off control signal to block the generation of the plurality of gate clock signals when at least one of the first and second feedback signals is lower than the reference voltage; and a switcher configured to turn off transmission channels of the plurality of gate generation signals in response to the switching-off control signal.

16. The display device of claim 15, wherein the error detection circuit comprises:

an AND gate configured to receive the first and second feedback signals and to perform an AND operation; and a comparator configured to compare an output voltage of the AND gate with the reference voltage.

17. The display device of claim 16, wherein the switching control circuit is configured to output the switching-off control signal when the output voltage of the error detection circuit is at a low level.

18. The display device of claim 9, wherein the display panel is an amorphous silicon gate (ASG) display panel.

* * * * *